US007446269B2

(12) United States Patent
Stringos

(10) Patent No.: US 7,446,269 B2
(45) Date of Patent: Nov. 4, 2008

(54) SWITCH IN PARTICULAR A BRAKE LIGHT SWITCH FOR A MOTOR CAR

(75) Inventor: Evan B. Stringos, G'Mangia (MT)

(73) Assignee: Methode Electronics, Incorporated, Wiesbaden (DE)

( * ) Notice: Subject to any disclaimer, the term of this patent is extended or adjusted under 35 U.S.C. 154(b) by 1035 days.

(21) Appl. No.: 10/466,115

(22) PCT Filed: Jan. 23, 2002

(86) PCT No.: PCT/EP02/00651

§ 371 (c)(1),
(2), (4) Date: Jul. 23, 2003

(87) PCT Pub. No.: WO02/059924

PCT Pub. Date: Aug. 1, 2002

(65) Prior Publication Data

US 2004/0051377 A1 Mar. 18, 2004

(30) Foreign Application Priority Data

Jan. 23, 2001 (DE) ..... 101 02 883

(51) Int. Cl.
*H01H 13/00* (2006.01)

(52) U.S. Cl. ..... 200/16 B

(58) Field of Classification Search ..... 439/16 B, 439/345, 296, 520, 341, 17 R, 16 C, 16 R, 439/329

See application file for complete search history.

(56) References Cited

U.S. PATENT DOCUMENTS

| | | | | | |
|---|---|---|---|---|---|
| 3,299,238 | A | * | 1/1967 | Cobb | 200/530 |
| 4,996,400 | A | * | 2/1991 | Ricci et al. | 200/345 |
| 5,389,756 | A | * | 2/1995 | Micallef | 200/345 |
| 5,853,084 | A | | 12/1998 | Carter et al. | 200/345 |
| 5,960,940 | A | | 10/1999 | Elting et al. | 200/296 |
| 6,204,463 | B1 | | 3/2001 | Stringos | 200/520 |

FOREIGN PATENT DOCUMENTS

| | | |
|---|---|---|
| DE | 29504049 | 9/1995 |
| DE | 19645059 | 10/1997 |
| DE | 19717757 | 10/1997 |
| EP | 840335 | 10/1997 |
| GB | 2312559 | 10/1997 |

* cited by examiner

*Primary Examiner*—Edwin A. León
(74) *Attorney, Agent, or Firm*—Jacobson Holman PLLC

(57) ABSTRACT

A rotatable locking member is located between a plunger of a switch and a contact part that is configured as a slide, with the rib-type locking elements of the locking member engaging corresponding groove-type locking elements of the plunger. The contact part is fixed in the axial direction on the locking member, but is mounted so that it can be rotated in relation to the member. In an initial position of the plunger, an anti-torsion device, which can be released by an unlocking action, secures the locking member against torsion. This allows both the plunger and the contact part to be accommodated by the housing of the switch so that they can be axially displaced, but are resistant to torsion, thus increasing the adjustment reliability and preventing undesired torsion of the locking member before the start of the adjustment process.

16 Claims, 2 Drawing Sheets

SWITCH IN PARTICULAR A BRAKE LIGHT SWITCH FOR A MOTOR CAR

CROSS-REFERENCE TO RELATED APPLICATION

This is a nationalization of PCT/EP02/00651 filed Jan. 23, 2002 and published in German.

BACKGROUND OF THE INVENTION

1. Field of Invention

The invention relates to a switch, in particular a brake light switch for an automobile with an axially displaceable plunger for the actuation of a make-and-break contact of the switch, whereby the plunger protrudes into a bore of a locking organ, i.e., member, which can be rotated relative around the plunger between an adjustment position and a locking position. The plunger and the locking organ have complimentary locking elements that are strung together in a comb-like manner in axial direction. The plunger can be axially adjusted in the adjustment position relative to the locking organ, and the locking organ can be rotated into the locking position in which the locking elements engage into each other in a radial overlapping manner and are fixed in the axial direction after the axial adjustment process has been completed.

2. Description of the Prior Art

Such a switch is known from EP 0840335 A2, for example. According to it, the locking organ is embodied as a slide that glides fixed into the axial direction inside of the switch housing, which carries a contact unit that can make contact with contact components that are seated stationary within the housing. The plunger is supported displaceable in longitudinal direction in the housing and can be rotated by means of a key-like actuating element, in which it is supported stationary and displaceable in longitudinal direction. The actuating element has an actuating finger protruding laterally, which protrudes into one of the recess areas of a mounting port that is embodied in a base component within the pedal space of the automobile.

The actuating finger overlaps the laterally protruding retaining fingers of the housing in the adjustment position of the plunger.

The retaining fingers are embodied corresponding to the recess areas, and can be plugged in through the same, whereby the actuating finger protrudes into the recess area. Once the switch is attached to the base component, the exterior surface end of the plunger that is pushed out of the housing to the maximum degree abuts the spring-loaded pedal lever in its initial position. Due to the fact that the locking element and the ribs are not engaged in the adjustment position, and because a tension spring of the plunger is weaker than the spring force of the pedal lever, the plunger is pushed into the housing and into the slide in a telescoping manner until the front of the housing abuts the base component, and the retaining fingers are completely pushed through the mounting port.

The housing is now rotated around its longitudinal axis so that the retaining fingers engage into the base component in the manner of a bayonet catch, thus fixing the switch. During this rotating motion the actuating finger is retained in the recess area, and thereby rotated in relation to the housing. This rotation is transferred to the actuating component, and therefore to the plunger, which is thereby rotated in relation to the slide that is stationary within the housing. Its groove-type locking elements are rotated to the angular segment of the rib-type locking element and axially fixed, which also causes the slide to be axially fixed onto the plunger. If the brake pedal is now pushed down, the plunger is released, and the slide is displaced against the contact elements together with the contact unit under the force of a compression spring, which causes the contact to be closed and the brake light to turn on.

Because the plunger is especially exposed it may happen that its rotation position is changed before or during the insertion into the mounting port due to unintentional exterior influences, which causes the engagement of the locking elements between the plunger and the slide in an axially false position. However, if a solution is chosen in which the plunger is stationary and the slide is rotated, the powerful frictionally engaging compression spring can be submitted to torsion, thereby exerting a rebound that compromises the safety of the locking position.

The invention is based on the task of increasing the functional safety of the switch

SUMMARY OF THE INVENTION

This task is solved by means of the features of the invention described herein.

It goes without saying that the sprocket-type locking elements on one of the two locking elements, i.e., on the locking organ, can be reduced down to one sprocket, or one groove, respectively. The actuating component that is rotatable in relation to the locking organ forms a separate coupling component that is rotatable in relation to the plunger and the contact maker that is embodied as a slide so that these two components can be displaced in fixed longitudinal guides within the housing, thus securing the locking device from any damaging influences. The actuating fingers are arranged mostly hidden underneath the retaining finger, and are hard to reach. Any exterior influences cannot take effect until they already protrude into the recess areas of the mounting port, and can then be rotated only conventionally. Any misalignment is thereby prevented to a large extent.

A similar effect is achieved by means of one feature of the unlockable anti-torsion device described herein. The device feature reliably prevents the misalignment of the plunger in relation to the locking organ until immediately before the start of the adjustment process.

Without such an anti-torsion device, even a slight rotation can cause the locking elements to engage and axially block the plunger in the locking organ so that a proper adjustment is no longer possible. Since the assembly into a pedal box of the automobile may possibly occur in a hidden manner without any sight control, any misalignment may not be easily recognized. Based on the invention, the torsion range does not become possible until immediately before the start of the adjustment process after a clearly perceivable minimum stroke so that a premature torsion can be safely avoided. It is of advantage that such a minimum stroke can be generated only by exerting a distinct effort against the effect of the return spring of the plunger, which largely prevents an unintentional caving of the plunger.

The structural features of the device described herein correspond to their effect in so far as they themselves safely prevent a misalignment during a hidden assembly until immediately before the start of the final adjustment process. They supplement and reinforce each other in their effect during the mutual operation in a switch in such a way that a nearly complete adjustment reliability is achieved.

Advantageous further embodiments of the invention are as described herein.

An exact allocation of the contact units to the contact elements is possible by means of the fixed guide of the contact maker in the housing as described herein. An unlocking effect is reliably avoided by means of the contact maker.

By means of further embodiments of the invention described herein, the contact unit, the contact maker, and the locking organ are allocated to each other in a simple manner and free of clearance.

By means of further embodiments of the invention described herein, the torsion movement of the actuating pins is transferred to the locking organ in a simple and safe manner. The axial range of torsion of the locking organ enables the axial range of torsion of the plunger and of the contact maker between stoppers after the assembly of the switch into the automobile.

The bore as described herein is guided through the interior end of the plunger so that stalling torques that are applied by the pedal lever are absorbed. Furthermore, the bore and pilot pin may have an out-of-round cross-section that prevents the torsion of the plunger in relation to the housing.

The return spring as described herein enables the reliable attachment of the plunger to the pedal lever during the adjustment process. The return spring embodied as a spiral compression spring is additionally routed in the plunger bore along its entire length, free of any kinks.

The axial release stroke as described herein represents a kinematically simple extension of the adjustment stroke and can be performed with the said adjustment stroke in a single operation.

The locking shoulder as described herein can be embodied, for example, as an axially oriented side edge of a locking cam, and can be positioned closely adjacent to the side edges of the overlapping locking elements.

The locking segment as described herein is arranged in the extended row direction of the locking elements. However, it is offset or broadened in axial direction so far that it covers at least one rib of the opposite locking organ in a positive fit, thus reliably preventing an unintentional torsion. The locking segment comes out of the engagement range of the opposite locking elements by means of the axial stroke of the plunger so that the torsion is no longer blocked.

By means of further embodiments as described herein, the switch can be easily attached to the base component in the manner of a bayonet catch. When the switch housing is rotated, the actuating pins 9 are retained in the recess areas of the base component, and rotated in relation to the housing and to the plunger. This movement is transferred to the locking organ via the actuating component, which is then axially locked on the plunger. The axial torsion range of the locking organ enables the axial torsion range of the plunger and of the contact maker between the stop units after the switch has been installed in the base component of the pedal box.

BRIEF DESCRIPTION OF THE DRAWINGS

The invention is explained in more detail in an embodiment example illustrated in the drawing figures. The drawing figures show.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 2:
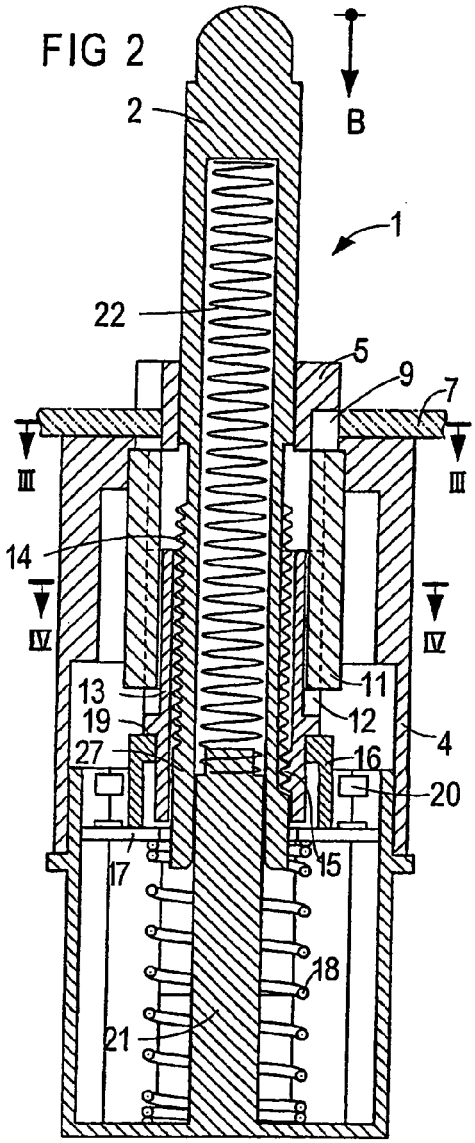
Figure 1:
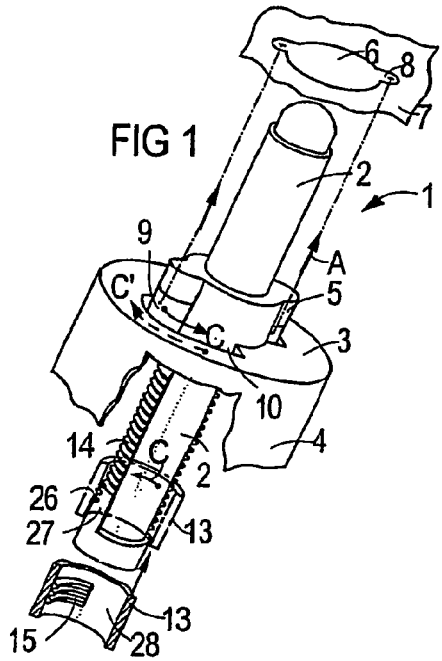
FIG. 1 a perspective partial view of a switch serving as a brake light switch with a plunger, FIG. 2 a section across the switch according to FIG. 1 along the line II-II in the FIGS. 3 and 4 in an adjustment position with a base component FIG. 3 a section across the switch along the line III-III in FIG. 2, FIG. 4 an enlarged partial section across the switch along the line IV-IV in FIG. 2, FIG. 5 a section across the switch according to FIG. 2 along the line V-V in FIG. 6 in a locking position, FIG. 6 an enlarged partial section along the line VI-VI in FIG. 5, FIG. 7 an enlarged detail VII from FIG. 6
Figure 3:
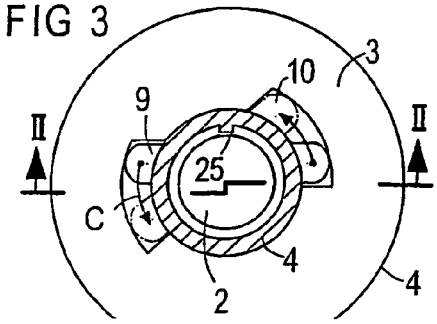

According to FIGS. 1, 2, and 3, an essentially cylindrical switch 1 embodied as a brake light switch has an axial plunger 2 that protrudes from one end 3 of the switch 1. A housing 4 of the switch 1 has retaining fingers 5 on the end, which can be plugged through a mounting port 6 of a base component 7 according to the motion arrow A, which is located in the pedal space of an automobile adjacent to the brake pedal lever. The base component 7 has lateral recess areas 8 in the mounting port 6, which are adjusted to the contour of the retaining fingers 5. The asymmetrical contour ensures the correct rotating position of the switch 1 on the base component 7. When inserted into the mounting port, the free plunger end abuts the pedal lever, which pushes the plunger 2 into the switch interior according to the arrow B with the plug-in motion. After the retaining fingers have been plugged in through the mounting port 6, the switch can be rotated according to arrow C', which enables the retaining fingers 5 to engage into the base component 7 in the manner of a bayonet catch, thus attaching the switch 1 to the base component 7.

Underneath the retaining fingers 5, rotatable actuating pins 9 protrude into the recess areas 8 in the mounting port 6, which are retained during the rotating of the switch 1 in the recess areas 8, and which can then be rotated in relation to the housing 4 according to arrow C into the locking position as shown in FIG. 1.

In order to enable this rotation, the end 3 of the housing 4 has segmented ring slots 10. The actuating pins 9 are embodied on the end of a pipe-like actuating component 11 that is equipped with parallel longitudinal slots for the fixed guide of respective longitudinal ligaments, i.e., posts 12 of a locking organ, i.e., member 13, which is rotated by means of the rotation of the actuating pins 9 with the plunger 2 for the axial locking. At its end the housing 4 has a protrusion 25 that protrudes fixed into a complementary exterior longitudinal groove of the plunger 2.

FIG. 1 shows part of the locking organ 13 in an exploded view outside of the plunger 2 in order to better view its structure. The actual assembly position of the locking organ 13 is indicated by the semicolon line associated with arrow A. Due to its fixed coupling with the actuating pins 9, the locking organ 13 is also rotatable in the direction of arrow C.

The plunger 2 is equipped with transverse, groove-type locking elements 14 that are strung together in the axial direction in the manner of a gear rack. For this purpose, the locking organ has complementary rib-type locking elements 15, which are located in the shown adjustment position outside of the angular area of the groove-type locking elements 14 in free segments 28 formed between the same so that the plunger 2 can be pushed into the pipe-like locking organ 13 in a telescoping manner. In the axial extension of the row of its locking elements 15, the plunger 2 is equipped with a groove-type locking segment 27 (see FIGS. 1 and 2), which is positioned in an initial position of the plunger 2 at the height of the locking elements 15 of the locking organ 13, and overlaps these locking elements in a circular projection with a lateral locking shoulder 26 (see FIG. 2) that is adjacent the locking segment 27. This ensures that the locking organ 13 is secured from any torsion of the plunger 2 in the initial position. When the plunger 2 is pushed into the housing 4, the locking segment 27 must initially vacate the area of the locking elements 15 of the locking organ 13 before any rotation and axial fixation are possible.

A fixed, axially displaced contact maker 16 in the housing is equipped with a contact unit 17, which is pushed against the contact maker 16 by means of a spiral-shaped compression spring 18, which again is pushed against a stop shoulder 19 of the locking organ 13 under the force of the spring in a rotatable manner.

In this way, the locking organ 13, the contact maker 16, and the contact unit 17 are fixed against each other in the axial direction so that the contact unit 17 can also be pushed against the contact elements 20 by means of the locking organ 13, which are seated stationary in the housing 4. The plunger 2 is equipped with a bore that is open toward the interior, into which a pilot pin 21 of the housing 4 protrudes. A return spring 22 in the form of a spiral compression spring is inserted in the bore and braced between the pilot pin 21 and the interior bore end so that the plunger 2 reliably abuts the pedal lever during the installation phase.

Figure 4:
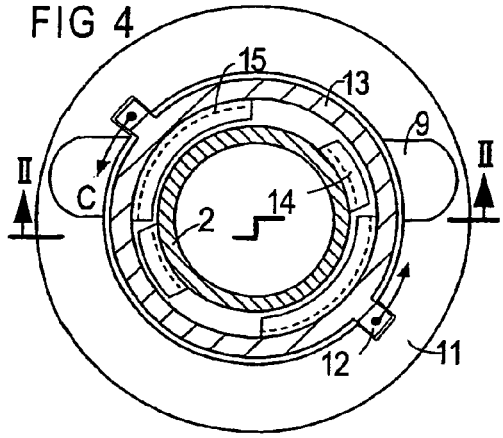

According to FIG. 4, the radii of the partially circular rib-type locking elements 15 and of the segmented groove-type locking elements 14 overlap each other in a circular projection. In the adjustment position shown, however, they are located in different angular segments so that they may slide past each other in the axial direction, and so that the plunger 2 located opposite of the locking organ 13 can be displaced.

Figure 5:
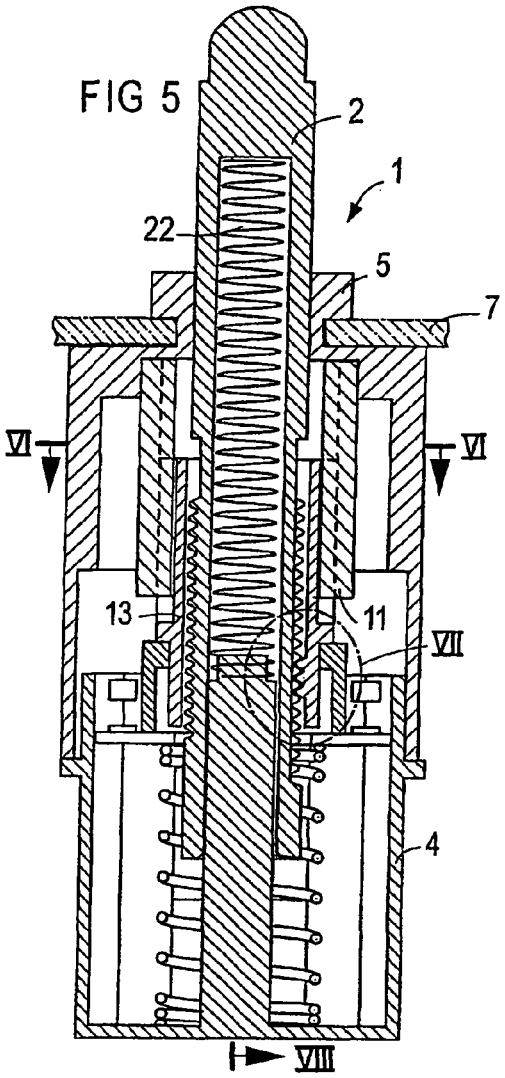
Figure 6:
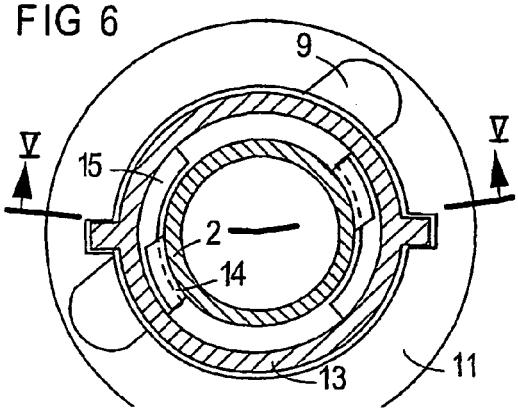

According to FIGS. 5 and 6, the plunger 2 is already axially adjusted, and pushed deeper into the switch 1. The locking segment 27 has been pushed out of the area of the locking elements 15 of the locking organ 13, which has cancelled the anti-torsion device. The housing 4 has already been rotated into the locking position, while the actuating pins 9 have rotated with the actuating component 11 and the locking organ 13 relative to the housing 4 and to the plunger 2. In this way the rib-type locking elements 15 of the locking organ 13 that point toward the interior, and the groove-type locking elements 14 of the plunger 2 that are open toward the exterior have engaged in a successive overlapping manner so that the locking organ 13, and therefore also the contact maker 16, is fixed axially opposite of the plunger 2, and can be operated by the same.

Figure 7:
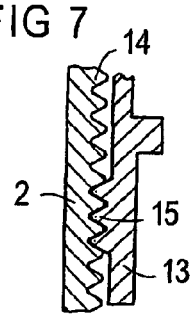

FIG. 7 shows the tooth profile of the locking elements (14, 15) of the locking organ 13, and of the plunger 10 in a thread-type engagement free of clearance. In order to facilitate the threading of the locking elements, the same may have chisel-type intake slants on the ends facing each other, which are not illustrated in detail.

Figure 8:
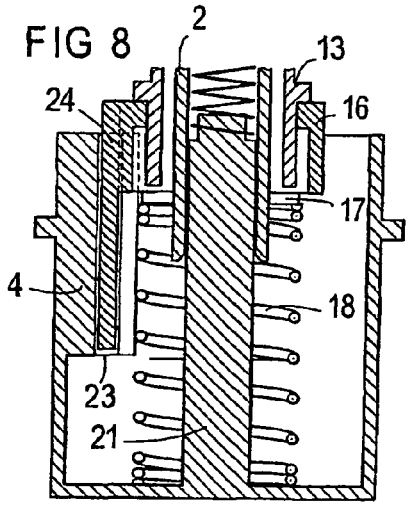
FIG. 8 a partial section across the switch along the line VIII in FIG. 6, FIG. 9 a top view of the switch parts according to FIG. 8.
Figure 9:
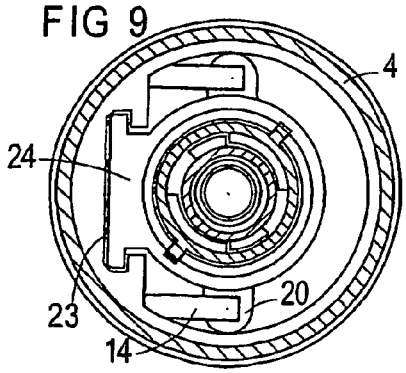

FIGS. 8 and 9 show that the housing 4 has a linear guide 23 in the shape of a T-nut in axial direction, in which a respective slide 24 of the contact maker 16 that is embodied as a slide engages free of clearance so that the same is accurately guided in the housing.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

REFERENCE SYMBOLS

1 switch
2 plunger
3 end
4 housing
5 retaining finger
6 mounting port
7 base component
8 recess area
9 actuating pin
10 ring slot
11 actuating component
12 longitudinal ligament
13 locking organ
14 rib
15 locking element
16 contact maker
17 contact unit
18 tension spring
19 stop shoulder
20 contact element
21 pilot pin
22 return spring
23 linear guide
24 slide
25 protrusion
26 locking shoulder
27 locking segment
28 free segment

What is claimed is:

1. Switch for an automobile comprising an axially displaceable plunger for the actuation of a make-and-break contact of the switch, the plunger protruding into a bore of a locking member which can be rotated relative to the plunger between an adjustment position and a locking position, the plunger and the locking member having complimentary locking elements that are configured in a comb-like manner in an axial direction so that the plunger can be axially adjusted in the adjustment position relative to the locking member, and the locking member can be rotated into the locking position in which the locking elements engage each other in a radial overlapping manner and fix themselves in the axial direction after the axial adjustment of the plunger, the locking member in the locking position being axially kinematically firmly coupled to a separate contact part, which is seated so as to be torque proof and axially movable in a housing of the switch, and which directly actuates the make-and-break contact.

2. The switch according to claim 1, wherein the housing has a linear guide aligned in the axial direction for the contact part.

3. The switch according to claim 2, wherein the linear guide is configured as a T-nut, into which a respective slide of the contact part engages.

4. The switch according to claim 1, wherein the make-and-break contact has a contact unit attached to the contact part, which can make contact in the locking position with contact elements that are anchored within the housing in the locking position; the contact unit can be pushed against the contact elements by a spring, and the spring pushes the contact part in the axial direction against a stop shoulder of the locking member.

5. The switch according to claim 4, wherein the spring is a spiral compression spring, which pushes the contact unit against the bottom of the contact part which faces an opposite side of the stop shoulder.

6. The switch according to claim 1, wherein the locking member is torque proof and axially displaceable in an actuating component for a utility stroke of the plunger, the actuating component protruding with actuating pins through segmented ring slots of one end of the switch.

7. The switch according to claim 6, wherein the actuating pins protrude underneath hook-type retaining fingers of the housing in the adjustment position, the retaining fingers are inserted through lateral recess areas of a mounting port of a base component within a pedal space of the automobile, such that the actuating pins protrude into the recess areas, and the retaining fingers engage behind the base component in a manner of a bayonet catch by rotating the switch such that the actuating pins are retained in the recess areas.

8. The switch according to claim 1, further comprising a pilot pin that is coaxial to the plunger and that is arranged on a side facing an interior end of the plunger so as to protrude into a bore of the plunger.

9. The switch according to claim 8, further comprising a return spring housed in the plunger bore.

10. The switch according to claim 1, wherein the locking elements are not engaged in the adjustment position, the switch has an unlockable anti-torsion device, which prevents any rotation of the locking member in relation to the plunger in an initial position of the plunger, and the locking member is rotatable in relation to the plunger after an unlocking action has taken place.

11. The switch according to claim 10, wherein the unlocking action includes an axial displacement of the plunger from the initial position into the adjustment position, and the entire axial displacement travel of the plunger is equal to the adjustment travel plus the unlocking travel.

12. The switch according to claim 10, wherein the locking elements are not engaged alternately in free segments between the complementary locking elements in the initial and adjustment positions, the locking elements radially overlap each other in the locking position, the locking member or the plunger has at least one locking shoulder forming an anti-torsion device, which engages in the initial position before the adjustment stroke of the plunger into the free segments, and overlaps with at least one of the locking elements in a circular projection, and the locking shoulder is arranged in alignment to a longitudinal end area of the respective locking elements.

13. The switch according to claim 12, wherein the locking shoulder is an end edge of a partially broadened locking segment, which is arranged in the axial extension of the row of locking elements, and which is congruent with the locking elements in the axial projection.

14. The switch according to claim 12, wherein the locking segment is arranged on the interior plunger end in alignment with the locking elements thereof, and overlaps at least one of the locking elements of the locking member in the initial position.

15. The switch according to claim 10, wherein the locking member is torsion proof and axially displaceable for a utility stroke in an actuating component, which protrudes together with the actuating pins through segmented ring slots of one end of the switch.

16. The switch according to claim 15, wherein the actuating pins protrude underneath hook-type retaining fingers of the housing in the adjustment position, the retaining fingers are plugged into a pedal space of the automobile through lateral recess areas of a mounting port of a base component, the actuating pins protrude into the recess areas, the retaining fingers engage into the base component in a positive fit in a manner of a bayonet catch by rotating the switch such that the actuating pins are retained in the recess areas.

* * * * *